US009332868B2

(12) United States Patent
Jensen

(10) Patent No.: US 9,332,868 B2
(45) Date of Patent: May 10, 2016

(54) HEADBAND AND BELT HANGER, HOLDER, AND ORGANIZER

(76) Inventor: Jesse Jensen, Katy, TX (US)

( * ) Notice: Subject to any disclaimer, the term of this patent is extended or adjusted under 35 U.S.C. 154(b) by 996 days.

(21) Appl. No.: 13/225,435

(22) Filed: Sep. 3, 2011

(65) Prior Publication Data

US 2012/0138642 A1 Jun. 7, 2012

Related U.S. Application Data

(60) Provisional application No. 61/459,080, filed on Dec. 7, 2010.

(51) Int. Cl.
*A41D 27/22* (2006.01)
*A47G 25/74* (2006.01)
*A47F 7/02* (2006.01)

(52) U.S. Cl.
CPC *A47G 25/746* (2013.01); *A47F 7/02* (2013.01)

(58) Field of Classification Search
CPC ..... A47G 25/746; A47F 7/02; A47F 1/10
USPC ..... 223/87, 85; 211/87.01, 89.01, 88.04
See application file for complete search history.

(56) References Cited

U.S. PATENT DOCUMENTS 501,392 A * 7/1893 Wiedenmann ..... B62J 11/00 224/42.36
1,801,950 A * 4/1931 Brown ..... 211/85.3
1,908,200 A * 5/1933 Webster ..... 248/495
2,330,373 A * 9/1943 Moore ..... 248/489
2,617,565 A * 11/1952 Suydam ..... 223/87
2,777,582 A * 1/1957 Van Dusen ..... 211/119
3,246,812 A * 4/1966 Walker et al. ..... 223/87
3,665,563 A * 5/1972 Batts ..... A44B 99/00 24/543
3,698,043 A * 10/1972 Batts ..... A44B 99/00 223/87
4,279,396 A * 7/1981 Bendock ..... A47K 3/38 24/530
4,712,761 A * 12/1987 Wassell ..... 248/475.1
6,449,886 B1 * 9/2002 Gray ..... G09F 3/20 281/21.1
D583,417 S * 12/2008 Maier-Hunke ..... D19/65
7,708,252 B2 * 5/2010 Vander Berg et al. ..... 248/544
2011/0012006 A1 * 1/2011 Serio ..... 248/467

* cited by examiner

*Primary Examiner* — Nathan Durham
(74) *Attorney, Agent, or Firm* — David McEwing

(57) ABSTRACT

A storage attachment device for headbands, belts, ear rings etc., comprising a first rigid flat piece having a front surface and a back surface and a bottom base, a second rigid piece having a front surface and a back surface and a bottom base and a top edge; and the bottom base of the first piece attached to the bottom base of the second piece wherein the first front surface forms a V shaped acute angle to the second back surface. A method of storing headbands, belts, ear rings, etc. by wedging an end of a headband into the V shaped acute angle and extending the second end of the headband over the top edge of the second surface. The device may also utilize one or more friction components.

16 Claims, 8 Drawing Sheets

SIDE VIEW

FRONT VIEW

HEADBAND AND BELT HANGER, HOLDER, AND ORGANIZER

RELATED APPLICATION

This disclosure claims priority to and incorporates by reference herein provisional application filed Dec. 7, 2010, application No. 61/459,080 entitled Headband Hanger, Holder and Organizer.

BACKGROUND OF DISCLOSURE

1. Field of Use

This disclosure pertains to a storage device and method for storing or displaying items of apparel such as headband, belts and ear rings.

2. Related Art

Storage devices such as bins, drawers, jewelry chests and hooks are known.

BRIEF DESCRIPTION OF THE DISCLOSURE

This is a unique device for holding and storing girls' headbands and other objects. Headbands are generally light weight, flexible semi-circular devices that are worn on the head. The radius of the headband arc is smaller than the wearer's head. The headband is made from flexible material and the radius of the arc is stretched wider when the headband is worn on the head.

This device (sometimes referred to hereinafter as "headband and belt hanger") provides a simple, convenient way to organize, store and if desired—display headbands. The device can also be used to store and organize belts. The device can also be used to store and display ear rings.

Headbands are difficult to organize and store. Girls often acquire many headbands and they become very hard to find, organize, store, etc. Due to their unique/irregular shape and large circular nature, they are often unorganized. For example, it is not possible to stack headbands. This disclosure provides a way to organize, store, display and or hold headbands. The current solutions on the market require that the headband go "around" or clamp onto a larger object to store it or simply hang on a loop or wire of some sort. The first solution can stretch and damage headbands. This invention does not stretch the headband at all, it simply holds the headband by one end.

Storing headbands in bins or boxes causes the headbands to be difficult to organize and causes it to be hard to find an individual headbands. The storage containers take up a great deal of room. This disclosure provides a method by which the headbands are stored without damaging or stretching the headbands in any way and makes them easy and convenient to find.

BRIEF SUMMARY OF THE DRAWINGS

The accompanying drawings, which are incorporated in and constitute a part of the specification, illustrate preferred embodiments of the disclosure. These drawings, together with the general description of the disclosure given above and the detailed description of the preferred embodiments given below, serve to explain the principles of the disclosure.

DETAILED DESCRIPTION OF THE DISCLOSURE

Please refer to the drawings attached for reference to the position and orientation of the structural components. The headband and belt hanger is a device configured to hold a headband securely for purposes of storage, display, organization, etc. The device can also be used to store or display belts, ear rings, etc.

This device can be made from a variety of rigid or stiff lightweight materials, included but not limited to plastic, wood, metal, etc. Plastics may include but are not limited to polyethylene, polypropylene, polyvinyl chloride, acrylate polymers and polytetrafluoroethylene (PTFE) or Acrylic. One method is extrusion of a moldable plastic due to the lower cost and the potential for a uniform profile. Other methods include machining the shape, stereo lithography, injection molding, or other methods of manufacturing for producing the desired shape for holding headbands by one edge, belts, ear rings for the purposes of storage, display, organization, etc.

One method of making the device as depicted in FIGS. 1, 2, 3, and 4 is by heating a piece of flat acrylic having a first surface and making a single bend. The bent second surface of the device forms an acute angle with the first surface. The bend forms a "V" shaped component.

Figure 1:
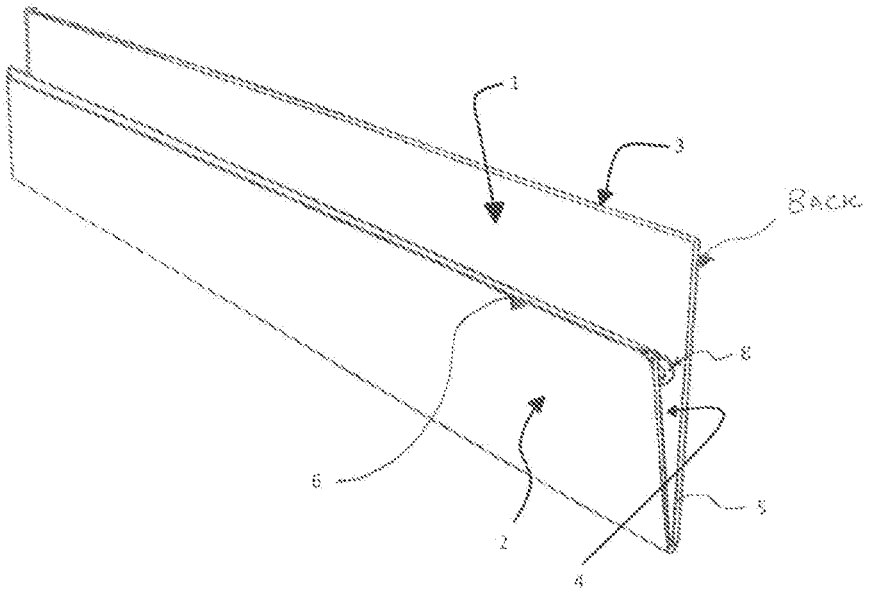
FIG. 1 is a schematic representation of the disclosure. Disclosed in the first rigid surface and the V shaped junction between the first rigid surface and the front second rigid surface.

Referencing FIG. 1, in one embodiment, the second rigid surface 2 forms an angle to the first rigid surface 1 of between 5° to 10°. In other embodiments, the angle may be between 1° and 20°.

FIG. 1 is a schematic view of the headband and belt hanger, holder and organizer. Illustrated is the first rigid surface 1 which forms the back surface that may be attached to a horizontal or vertical surface. The back surface 3 may contain one or more adhesives strips used to attach the device to a surface. The first rigid 1 surface may further contain pre drilled holes or other apertures through to the back surface (not shown) to facilitate fastening of the device by means of nails or screws to a surface.

Figure 2:
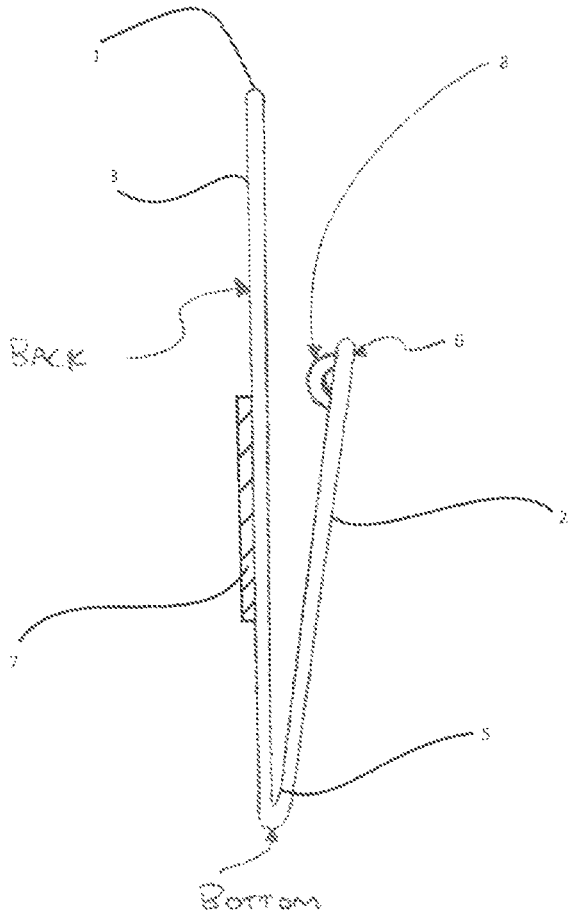
FIG. 2 is an end view of the device showing the first (back) rigid surface, the V shaped component joining the first rigid surface to the second (front) rigid surface. Also illustrated is optional material for additional friction that can be installed proximate to the top edge of the second rigid surface.

FIG. 2 illustrates a side view of this device. The device is shaped with a "V" shaped bottom 5 or junction between the base of the first rigid surface 1 and the second rigid surface 2. The second rigid surface 2 can be thought of as the front of the device. The second rigid surface contains a top edge 6 used in holding the headband, belt or ear rings. In the embodiment illustrated in FIG. 2, a strip of material 8 (friction component) is attached proximate to the top edge 6. The strip can be a material that provides friction against a headband. In that manner, the strip facilitates holding the headband in the device. FIG. 2 also illustrates an adhesive strip 7 attached to the back 3 of the first rigid surface 1.

Figure 3:
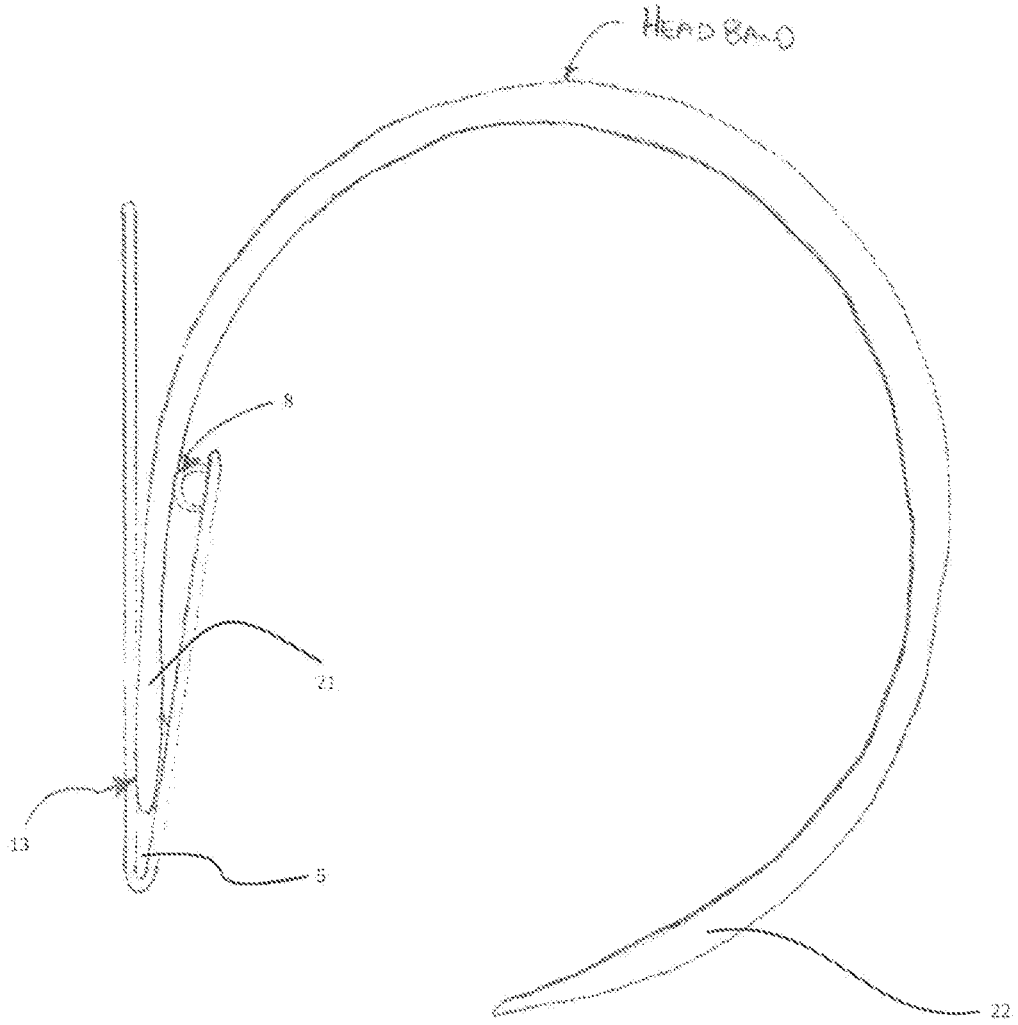
FIG. 3 is an end view of the device (headband and belt hanger) showing placement of a headband for storage in the device.
Figure 4:
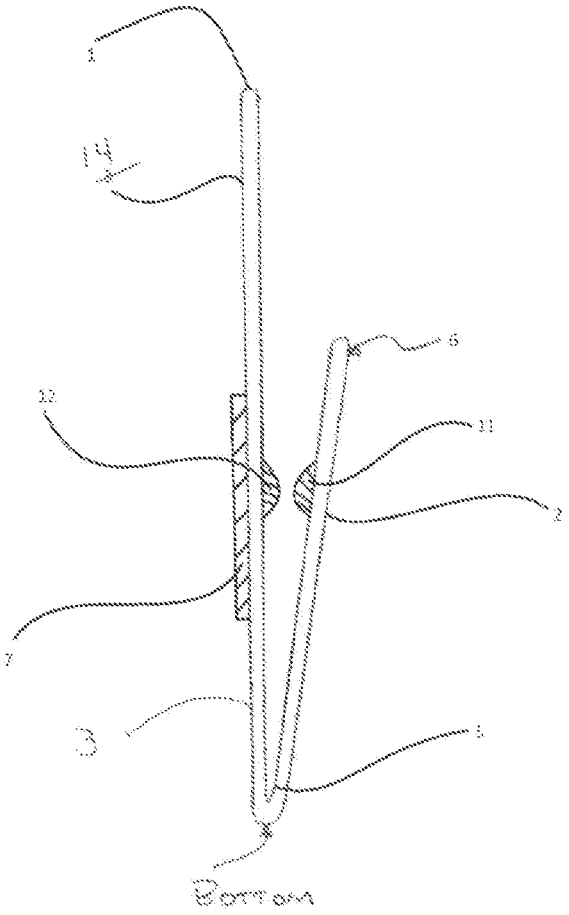
FIG. 4 is an end view of the disclosure showing another embodiment comprising friction components place on the first rigid surface and second rigid surface.

In one embodiment illustrated by FIG. 4, the top 14 of the first rigid surface extends above the top edge 6 of the second surface. It will be appreciated that holes or apertures may be formed in this top 14 are of the first surface to facilitate attachment of the device to a surface, e.g., wall. Also referencing FIG. 4, the V shaped bottom or junction 5 or the first rigid surface 3 and the second rigid surface 2 may contain a liner (friction strip). This liner may be soft, pliable, elastomeric or tacky. It may contain two parts 11, 12 with an intervening slit or space between the two parts. The side of a headband, positioned as illustrated in FIG. 3, can be wedged or fit between the friction strips 11, 12 shown in FIG. 4. It will be appreciated that the friction strips 11, 12 narrow the space between the first rigid flat piece 3 and the second rigid flat piece 2. It will be further appreciated that each of the friction strips 11, 12 can be positioned opposite the opposing friction strip. The headband or belt can be wedged between the two friction strips and extend over the top edge 6 of the second surface. The two part liner may form the friction strips holding the headband. It will be appreciated that other configurations of friction strips are possible after review of this disclosure. The friction strip can be made of an elastomeric material. In another embodiment, the material surface may be tacky. Material of this type is taught, for example, by U.S. Pat. No. 5,688,860 issued to Croft.

Figure 6:
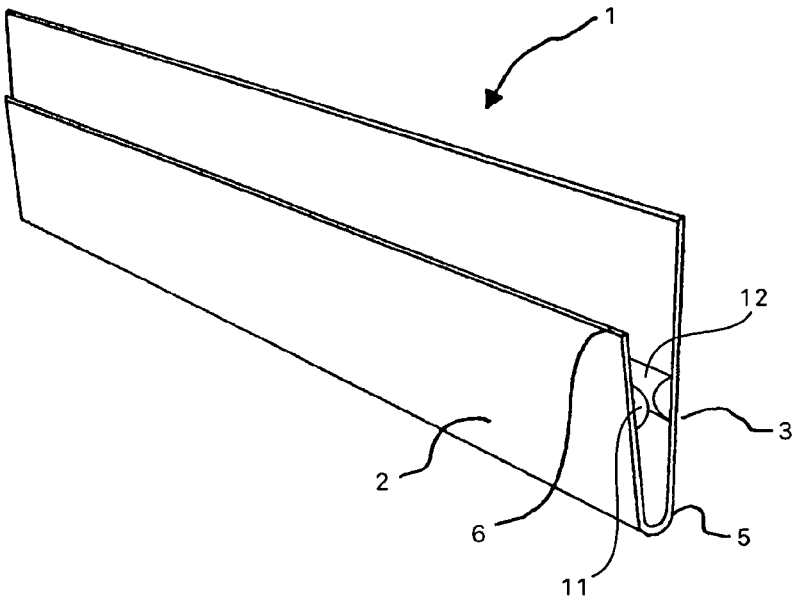
FIG. 6 illustrates a perspective view of the device subject of the disclosure comprising an elongated first rigid flat piece and an elongated second rigid flat piece with two friction strips each attached the first rigid piece and a second rigid piece respectively. Each friction strip extends along the elongated length of the V shaped device subject of the disclosure. This configuration is also shown as an end view of FIG. 4.

FIG. 6 shows a perspective view of the embodiment illustrated in FIG. 4 and discussed above. Illustrated is the front 2 of the second rigid flat piece of the V shaped structure 1, the top edge 6 of the second rigid flat piece, the V shaped bottom component 5 joining the second rigid flat piece to the first front rigid piece 3. Also illustrated are the two oppositely positioned friction components 11, 12.

Figure 7:
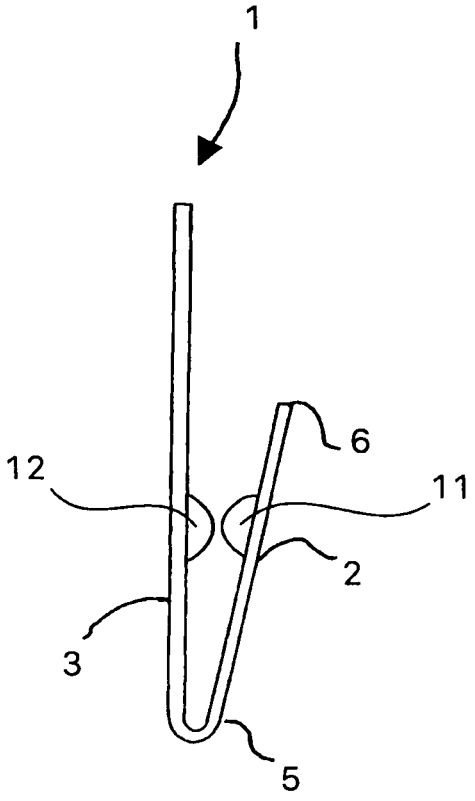
FIG. 7 illustrates another embodiment of the device illustrated in FIG. 6 wherein the friction strips may extend from their respective rigid surfaces to proximity with the counterpart friction strip forming an intervening slit or space between the two friction strips.

FIG. 7 is another side view of the V shaped structure 1 showing the first rigid flat piece 3, the second rigid flat piece 2 and the oppositely positioned opposing friction strips 11, 12.

Figure 8:
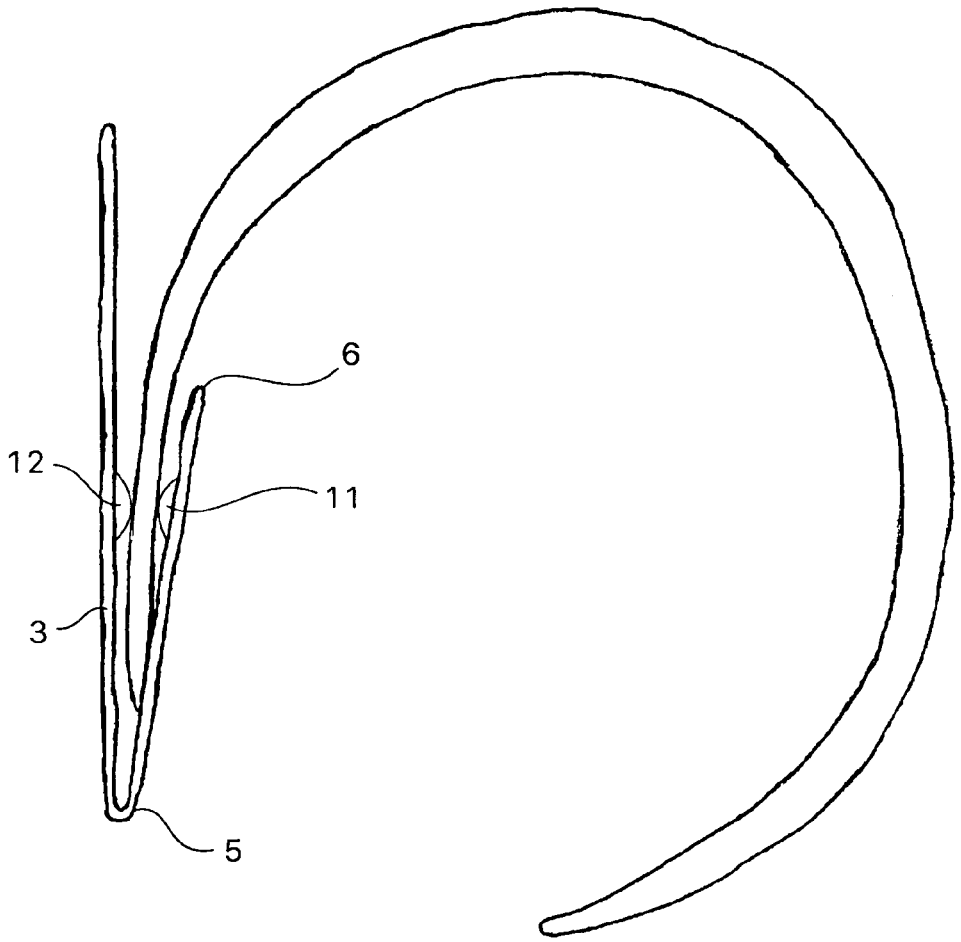
FIG. 8 is an end view showing a headband positioned in the device similar to the view of FIG. 3 but further showing a combination of a first and second friction component.

FIG. 8 illustrates another side view of the structure 1 with a portion of a headband inserted or wedged between the two friction strips 11, 12. Please notice the end of the inserted portion 21 of the headband 20 does not touch the bottom 5 of the V shaped structure.

As shown in FIG. 3 discussed further herein shows one end 21 of a headband placed into the V shape structure. Also illustrated in FIG. 3 is the second end 22 of the head band. The first end of the headband is wedged 13 in the V shaped structure (optionally using one or more friction components) and the second headband end 22 extends over the top edge 6 of the second surface. The elastomeric strip can create a friction surface (hereinafter "friction strip") to hold the headband in place. The piece of the elastomeric material 8 may also create a mechanical binding between which the headband end is held.

It will be appreciated that the V shape structure can be formed from bending a single piece of thermoplastic or thermosetting material. It can also be formed from bending metal. In yet another embodiment, the juncture between the first rigid surface and second rigid surface may be of metal welded into a V shape. In another embodiment, the juncture between the first surface and second rigid surface can be rigid plastic chemically bonded together, e.g., solvent or fusion welding. The two pieces (first and second rigid surfaces) can form the V shaped juncture by gluing or use of adhesives of the two pieces or by mechanically attaching the two pieces by means that include but are not limited to staples, nails or screws.

FIG. 2 provides a side view of the invention. It will be appreciated that the V shape juncture may be substituted for a variety of other shapes including a "U" or a square or any other shape in which one edge of the headband is held by friction or wedging in between one or more materials such as friction components 8. FIG. 3 provides a view of the headband in the invention and particularly an end of a headband 21 wedged 13 in the V structure 5.

The headband and belt hanger can be any length, the longer the device the more headbands it can hold. The headband and belt hanger can also be used to hold belts. In this application, the belt buckle is place at the bottom of the V structure 5. The acute angle of the second rigid surface holds the belt buckle in between the first and second rigid surfaces. The belt is held by draping the belt over front top edge 6 of the second side. It will be appreciated that a tall second side will facilitate the holding of the belts. The device can also be used for hold ear rings that include an elongated wire hold as used with pierced ears. The elongated hold can be held by the front top edge 6 of the second rigid side.

The headband and belt hanger is preferably (but not necessarily) between about 1 inch and 5 inches tall with one side of the "V" being slightly taller (but not necessarily taller) than the other side of the "V". See FIG. 1 for a perspective view of the invention. In one embodiment, the first surface is taller than the second surface to provide an accessible surface for attaching (with screws, nails, etc.) the first surface to a structural surface, e.g., closet shelf. The headband and belt hanger can be attached to a surface (such as a wall, door, shelf, mirror, or any other surface) by any mechanical fastening device available including but not limited to staples, screws, nails, wire, foam or by adhesive materials such as tape, glue, liquid adhesives or other chemical or mechanical means of fastening to a surface.

The "V" shape may be modified to be more effective by adding an additional means by which to increase the friction between the device and the headband. FIGS. 2, 3 and 4 show examples of these optional materials. Illustrated in FIGS. 2 and 3 is a strip 8 of foam or similar material providing a source of friction. The strip is place proximate to the front top edge 6. This strip contacts the inside surface of a headband as the headband extends out of the device. See FIG. 3. This modification could include, but is not limited to, any material that could be added to securely hold the headband in the "V" shape or any other shape that might be produced for the purposes of holding a headband by one side for storage, display, organization, etc. In one embodiment, the material may be an elastomeric.

Methods or components for increasing headband holding friction could include (but are not limited too) foam inserts, flexible tubing or other materials, or any other materials (hereinafter "friction components") that add to the friction between the headband and the headband and belt hanger's surface.

It will be appreciated that if the height of the second rigid surface is sufficient, no additional material will be required. For example, if the radius of the headband is 6 inches, a 5 inch high second rigid surface may be sufficient to hold the headband.

The headband and belt hanger is fastened to a wall, door, cupboard, mirror, or any other surface by adhesives, glue, tape, screws, bolts, nails, etc. It can be secured in any orientation, with the "back" of the headband and belt hanger secured to the surface. The back of the headband and belt hanger would be the first rigid surface of the device. FIG. 2 illustrates an adhesive strip 7 placed on the back 3 of the first rigid surface. The headband and belt hanger device could also be installed on a stand (not shown), and offered as a "free standing" device held upright on a flat surface. The stand would have to have a sufficiently broad base to support the multiple headbands extending from the device. The headbands are held in place on the headband and belt hanger by friction, or by wedging the one side of the headband into the "V" shape of the headband and belt hanger. It will be appreciated that increasing the height of the second surface will facilitate holding the headbands or belts. FIG. 5 illustrates a side view of three horizontally mounted headband and belt hanger devices. Also shown is the friction component mounted on the device. Also shown is a front view of the device. It will be appreciated that each headband and belt hanger device can be mounted on board, plate, panel or other surface attached to a wall.

Figure 5A:
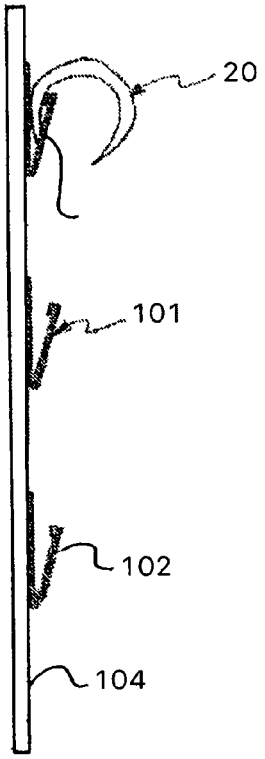
FIG. 5A is a side view of an embodiment of the disclosure wherein multiple horizontally positioned V shaped components are mounted on a vertically oriented component where the combination may be mounted on a vertical surface such as a wall. Also shown are friction strips comprising strips attached to the front second rigid surface.
Figure 5B:
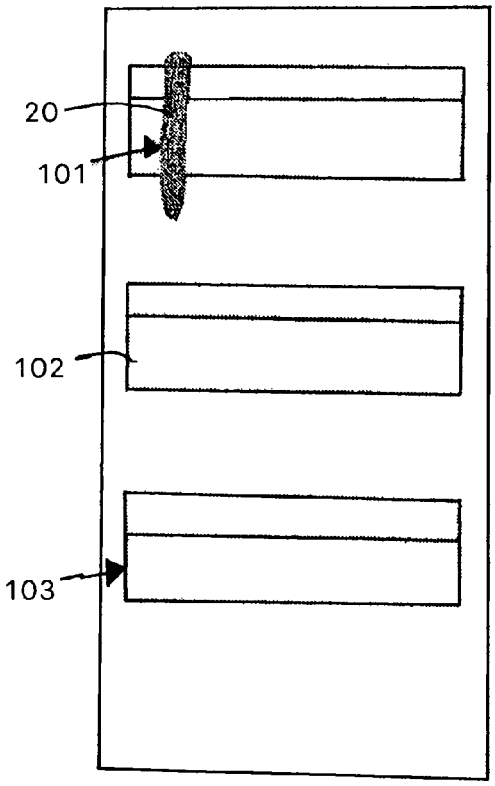
FIG. 5B illustrates a front view of the embodiment of FIG. 5A. A headband is also shown held in a horizontally positioned V shaped component.

In another embodiment, the headband and belt hanger can be configured into multiple "V" shaped structures. These multiple structures can be each horizontally mounted but mounted vertically in orientation to each other structure. This embodiment is illustrated in FIG. 5A and FIG. 5B. FIG. 5A shows a side view of 3 elongated V shaped structure 101, 102 and 103. Each horizontally mounted elongated V shaped structure is mounted to a vertical frame 104. FIG. 5A also illustrates a headband 20. FIG. 5B illustrates a front view of this configuration shown in FIG. 5. The "V" shaped structures can, in a further embodiment, be mounted to a single mounting piece 104, e.g., fabric, that can be mounted to a surface with hooks or similar attachments (not shown). This embodiment is not limited to three horizontally mounted elongated V shaped structures.

The headband and belt hanger could also have other shapes besides a "V" shape that provided friction between the headband holder and the headband. The user simply places the headband into the headband holder by pushing one edge of the headband into the holder and wedging the edge of the headband in place. This effectively holds the headband by one edge and does not stretch out the headband. The combination of the shape of the device and the materials chosen for the headband holder provide a sufficient wedging, or friction action between the device and the headband. Once the headband is installed on a surface, or on a free standing stand, the user simply puts one side of the headband into the "V" shape (FIG. 3). Headbands vary significantly in width, so a headband and belt hanger of a certain length could accommodate a varying number of headbands depending on how wide they are.

When a person is ready to use a headband, they simply pull the headband out of the hanger and place on their head. Once headband wearing is complete, the user simply puts the headband back into the headband holder where friction holds the headband in place.

In addition, this specification is to be construed as illustrative only and is for the purpose of teaching those skilled in the art the manner of carrying out the invention. It is to be understood that the forms of the invention herein shown and described are to be taken as the presently preferred embodiments. As already stated, various changes may be made in the shape, size and arrangement of components or adjustments made in the steps of the method without departing from the scope of this invention. For example, equivalent elements may be substituted for those illustrated and described herein and certain features of the invention maybe utilized independently of the use of other features, all as would be apparent to one skilled in the art after having the benefit of this description of the invention.

While specific embodiments have been illustrated and described, numerous modifications are possible without departing from the spirit of the invention, and the scope of protection is only limited by the scope of the accompanying claims.

What I claim is:

1. A storage attachment device comprising a) one or more first rigid flat piece each having a front surface and a back surface wherein the back surface is configured to fit proximate to a vertical oriented surface and first rigid flat piece also comprises a rigid bottom base;

b) a second front rigid flat piece for each first rigid flat piece having a front surface and a back surface and a smooth top edge;

c) the bottom base of each first rigid flat piece attached to the second front rigid piece wherein the first rigid flat piece and the second front rigid flat piece form a V structure, the first rigid flat piece and the second front rigid flat piece extending upward from the rigid bottom base and laterally away from one another;

d) at least two friction strips of soft, flexible, elastomeric or tacky material positioned upon and extending outward from and into a space between the front surface of the first rigid flat piece and the back surface of the second front rigid flat piece structure to hold an object between the front surface of the first rigid flat piece and the back surface of the second front rigid flat piece structure and the at least two friction strips extending across a length of the front surface of the first rigid flat piece and the back surface of the second front rigid piece, respectively and e) the each friction strip does not extend to a bottom base of the respective rigid flat piece structure.

2. The storage attachment device of claim 1 wherein the bottom base of the first rigid flat piece forms a V structure to the second back surface and the bottom base, the back surface of the first rigid flat piece is horizontally oriented to the vertically oriented surface.

3. The storage attachment device of claim 1 wherein the device is an extruded material structure.

4. The storage attachment device of claim 1 wherein the device is an injection molded structure.

5. The storage attachment device of claim 1 wherein the device is a stereo lithographic structure.

6. The storage attachment device of claim 1 further comprising a space between the second rigid flat piece top edge and the front surface of the first rigid flat piece.

7. The storage attachment device of claim 6 further comprising the space between the second rigid flat piece top edge and the front surface of the first rigid flat piece of between 0.25 inches and 1.00 inches.

8. The storage attachment device of claim 1 further comprising the first rigid surface including an adhesive strip.

9. The storage attachment device of claim 1 further comprising apertures through the first rigid flat piece surface.

10. The storage attachment device of claim 1 wherein the first flat surface for attaching the device to the surface and a second front piece comprise a single piece of material bent in a V shape.

11. A storage attachment device comprising a single piece of flat rigid material having a length and a width further comprising a rigid bend across the length of the piece forming a first rigid flat piece having an edge, a back surface and a front surface joined to a second rigid flat piece surface having a front surface and a back surface and a smooth front edge; the first rigid flat piece and the second rigid flat piece form a V structure wherein the rigid flat pieces are joined by the rigid bend and form an acute angle therebetween, and further comprising two or more elastomeric or tacky friction strips extending outward from (i) the front surface of the first rigid flat piece and (ii) the back surface of the second rigid flat piece into a space between the front surface of the first rigid flat piece and the back surface of the second rigid flat piece, the first rigid flat piece and second rigid flat piece positioned to hold an object between the first rigid flat piece and the second rigid flat piece.

12. The storage attachment device of claim 11 further comprising an adhesive component on the back surface of the first rigid flat piece.

13. The storage attachment device of claim 11 further comprising apertures through the first front flat surface of the first rigid flat piece for attaching the device to a surface.

14. The storage attachment device of claim 11 further comprising a rigid plastic structure.

15. A storage attachment device comprising a. a first rigid flat piece having a front surface and a back surface wherein the back surface is configured to fit proximate to a vertical oriented surface and the first rigid flat piece also comprises a rigid bottom base b. a second front rigid piece having a front surface and a smooth back surface and a straight, smooth and single top edge;

c. the rigid bottom base of the first piece attached to the second piece wherein the back surface of the second rigid front piece is positioned at an acute angle with respect to the first rigid flat smooth piece, the first rigid flat piece and the second front rigid piece forming a V structure;

d. a plurality of friction strips wherein at least one second friction strip is positioned on the second back surface of the second rigid front piece and one first friction strip is positioned on the front surface of the first rigid flat piece; and e. the surfaces of first friction strip and second friction strip extend from the second back surface of the second rigid front piece and the front surface of the first rigid flat piece, respectively.

16. The storage attachment device of claim 15, further comprising wherein the first and second friction strips are positioned opposite the other and each friction strip does not extend to the bottom base of the respective rigid flat piece structure.

* * * * *